US005205840A

United States Patent [19]

Friswell et al.

[11] Patent Number: 5,205,840

[45] Date of Patent: Apr. 27, 1993

[54] MARKERS FOR PETROLEUM, METHOD OF TAGGING, AND METHOD OF DETECTION

[75] Inventors: Michael R. Friswell, Wayne; Michael P. Hinton, Neshanic Station, both of N.J.

[73] Assignee: Morton International, Inc., Chicago, Ill.

[21] Appl. No.: 769,033

[22] Filed: Sep. 30, 1991

[51] Int. Cl.[5] ..... C10L 1/22

[52] U.S. Cl. ..... 44/428; 44/426; 44/427; 44/429

[58] Field of Search ..... 44/426, 427, 428

[56] References Cited

U.S. PATENT DOCUMENTS

| | | | |
|---|---|---|---|
| 3,164,449 | 1/1965 | Buxbaum | 44/312 |
| 3,435,054 | 3/1969 | Kranz et al. | 44/312 |
| 4,209,302 | 6/1980 | Orelup | 44/425 |
| 4,735,631 | 4/1988 | Orelup | 44/428 |

*Primary Examiner*—Ellen McAvoy

*Attorney, Agent, or Firm*—Wayne E. Nacker; Gerald K. White

[57] ABSTRACT

Liquid petroleum products are tagged with a marker which is a compound or mixture of compounds having the formula:

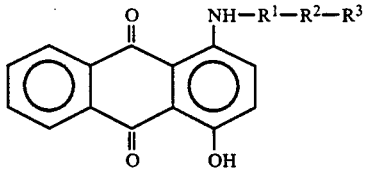

wherein $R^1$ is $C_1$–$C_6$ alkyl, and $R^2$ and $R^3$ are nothing or —O—($C_1$–$C_3$ alkyl).

4 Claims, No Drawings

MARKERS FOR PETROLEUM, METHOD OF TAGGING, AND METHOD OF DETECTION

The present invention is directed to the tagging of petroleum products with markers and to detection of such markers in petroleum products.

BACKGROUND OF THE INVENTION

It is known to tag petroleum products with markers, as for example as taught in U.S. Pat. Nos. 4,209,302 and 4,735,631, the teachings of each of which are incorporated herein by reference.

A dye is defined herein as a material lending visible color when dissolved in the dyed product. Examples of dyes which have been used for dyeing organic liquids are Color Index Solvent Red #24, Solvent Red #19, Solvent Yellow #14, Solvent Blue #36, and Solvent Green #3.

A marker is defined herein as a substance which can be dissolved in a liquid to be identified, then subsequently detected by performing a simple chemical or physical test on the tagged liquid. Markers that have been proposed, or are in use, include furfural, quinizarin, diphenylamine and radioactive materials. (Radioactive materials have not been accepted in Western countries because of special equipment and precautionary measures associated with their handling.)

Dyes and markers are needed to clearly distinguish chemically or physically similar liquids As one example, fuels are dyed or tagged to provide visually distinctive brand and grade denominations for commercial and safety reasons. As another example, some lightly taxed products are dyed or tagged to distinguish them from similar materials subject to higher taxes. Furthermore, certain fuels are dyed or tagged to deter fraudulent adulteration of premium grade products with lower grade products, such as by blending kerosene, stove oil, or diesel fuel into regular grade gasoline or blending regular grade gasoline into premium grade gasoline. Identification of particular batches of bulk liquids for protection against theft is another valuable function of markers and dyes, particularly for identifying fuels owned by large government, military or commercial consumers. Finally, marketers of brand name products dye or tag their products to detect substitution of others' products in their distribution system.

Dyes alone are not always adequate to securely and reliably identify liquids. Many dyes are easily removed by unauthorized persons. Furthermore, dyes can be obscured by other natural or added substances (particularly dyes present at low concentrations in a mixture of fuels). Because dyes alone have these shortcomings, a combination of a dye and a marker often is used to tag fuel.

Above-referenced U.S. Pat. No. 4,735,631 recites important characteristics of certain desirable markers for petroleum include:

1. are entirely foreign to the liquids;
2. can be supplied as highly concentrated solutions in compatible solvents;
3. are easily detected by a simple field test;
4. are not obscured by unstable natural components of the liquids;
5. are stable over the anticipated storage life of the tagged liquid (usually three to six months); and
6. have identities which can be confirmed by laboratory methods.

The markers of the present invention are preferably used at such concentrations and in such manner that they cannot be observed in the petroleum product until appropriately extracted in concentrated form from the petroleum product. If used at concentrations of less than about 10 ppm, the markers impart almost no detectable color, even to a clear, colorless petroleum product. If used in a naturally yellow petroleum product, the observable effect, if any, of the marker is that of a blue whitner, brightening the petroleum product. The marker will be totally obscured by any dye used to impart a color to the petroleum product.

Markers of the present invention are also advantageous is that they provide quantitative determinations. Most markers are adequate for detection of their presence in petroleum product; however, many available markers do not provide a good quantitative measurement of their levels in liquid petroleum products. Quantitative determinations are particularly important in cases where dilution is suspected, e.g., dilution of a higher-taxed fuel with a lower-taxed fuel.

SUMMARY OF THE INVENTION

In accordance with the present invention, liquid petroleum products are tagged with a marker of the general classes of chemicals described as 1-alkyl-amino-4-hydroxy-9,10 anthracene diones and 1-alkoxy-amino-4-hydroxy-9,10 anthracene diones. These chemicals are known collectively as "marker purples". Preferably a mixture of a 1-alkyl-amino-4-hydroxy-9,10 anthracene dione and a 1-alkoxy-amino-4-hydroxy-9,10 anthracene dione is used. A marker at a level of about 1 parts per million (ppm) or above is added to a liquid petroleum products. The marker may be detected in the petroleum products by extraction with a reagent comprising water, a strong base and preferrably a water-soluble oxygenated cosolvent or a water-soluble amine cosolvent. This reagent system not only extracts the marker from the liquid petroleum product, but causes the marker to react or complex, producing a clearly defined color that identifies the petroleum product as to source, permitted use, etc.

DETAILED DESCRIPTION OF CERTAIN PREFERRED EMBODIMENTS

The markers of the present invention have the general formula:

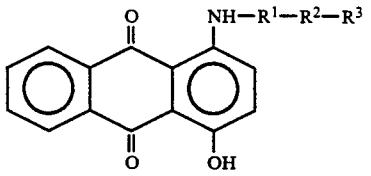

wherein $R^1$ is $C_1$–$C_6$ alkyl, and $R^2$ and $R^3$ are nothing or —O—($C_1$–$C_3$ alkyl).

These compounds have purple colors, the exact hue of which may vary, depending upon the substituent group at the amine. However, at the levels used to mark petroleum products, typically in the range of from about 1–10 ppm, and almost never more than about 100 ppm, the marker imparts little visible color to the petroleum product. If used in conjunction with a dye, the purple color of the marker may add some brightness.

The markers of the present invention are solids at room temperature but are preferably provided as petroleum additives in liquid form as a concentrated solution in a petroleum-miscible solvent. Preferred solvents are high-boiling aromatic solvents, such as alkylated-beta-naphthols and "liquid aromatic 200". By "high-boiling" is meant herein a solvent having a boiling point of about 200° C. or above. It is somewhat difficult to dissolve the markers of the present invention; accordingly, it is preferred that the markers be synthesized in a petroleum miscible solvent and never crystallized therefrom. It is desirable that a marker solution contain at least about 15 wt. percent marker and more preferably about 20 wt. percent. It is found that the most concentrated marker solutions are obtained when the marker is a mixture of a 1-alkyl-amino-4-hydroxy-9,10-anthracene dione and a 1-alkoxy-amino-4-hydroxy-9,10-anthracene dione. Such mixtures can be prepared by reacting 1,4-dihydroxy anthraquinone with a mixture of an alkyl amine and an alkoxy amine. Generally, the molar ratio of the 1-alkyl-amino-4-hydroxy-9,10-anthracene dione to the 1-alkoxy-amino-4-hydroxy-9,10-anthracene dione is between about 5:1 and about 1:5 most preferably in the range of between about 8:2 and about 6:4.

According to a preferred method of the present invention, the purple dyes are prepared by reaction of quinizarine, reduced (Leuco) quinizarine or a mixture of quinizarine and reduced quinizarine with an equal molar amount of an amine of formula $H_2N—R^1R^2R^3$ wherein $R^1$, $R^2$ and $R^3$ are as defined above. To obtain the preferred mixture of dyes as discussed above, a mixture of amines, including an amine wherein $R^2$ and $R^3$ are nothing and an amine wherein at least $R^2$ is —O—($C_1$-$C_3$ alkyl), is reacted with quinizarine and/or reduced quinizarine. The reaction is carried out in a solvent system which is a mixture of a polyglycol, such as polyethylene glycol or polypropylene glycol, and a relatively low-boiling aromatic, such as xylene or toluene. (By "low-boiling aromatic" is meant herin an aromatic compound or mixture of aromatic compounds having a boiling point(s) below about 140° C.) Subsequent to the reaction, the dye is oxidized to convert reduced (or Leuco) species to oxidized purple dye species. This oxidation is conducted in the presence of the glycol of the reaction solvent system. To produce high concentrations of the dye in high boiling solvents, the dye is never crystallized from the reaction solution. Instead, the reaction solvent system is stripped while concurrently being replaced with a high-boiling aromatic solvent. The dye is thereby maintained in solution at all times.

This preferred method of producing dyes has several advantages over conventional processes which prepare such purple dyes as solid crystals. Conventional processes generally produce between about 8 and 9% unwanted blue dyes, which are the 1,4-di-substituted-amino-anthracene diones; the present process reduces the blue dye level to about 2-3%. Prior art crystallizing procedures typically produce about 1-2% insolubles; whereas the method of the present invention produces substantially no insolubles. Very importantly, when the purple dyes are prepared as solids, they are very hard to redissolve, and practically it is difficult to obtain solutions of greater than about 2-3 wt. %; whereas using the method of the present invention, solutions of up to about 25 wt. % purple dye in high boiling aromatic solvent may be produced.

Furthermore, maintaining the dyes in liquid form minimizes worker exposure to the dyes.

The concentrated purple dye solutions in accordance with the invention are miscible with liquid petroleum products in all proportions and disperse within the liquid petroleum products readily. The liquids can be easily metered into a pipeline or storage tank at any dosage rate desired.

The final amount of marker in the tagged liquid petroleum product will depend upon a variety of factors. For most common detection methods, it is usually considered advisable to have at least about 1 ppm in the finally tagged liquid petroleum product. Usually, however, a somewhat greater amount will be provided, e.g., 20 ppm or more, but seldom over 100 ppm, enabling the marker to be detected, should the tagged petroleum product be diluted in untagged petroleum product. It is generally desirable to provide an amount of marker that might be detected in a simple field test. Of course, where sophisticated testing equipment is available, it may be possible to use even less marker.

The markers in accordance with the invention may be extracted in an alkaline aqueous solution containing an oxygen-containing cosolvent. The extractant preferably comprises between about 20 and about 100 volume percent of an aqueous solution of between about 0.5 and about 10 wt. % NaOH or KOH. The balance, i.e., up to about 80 volume percent, is cosolvent which is either a water-soluble oxygenated cosolvent, a water-soluable alkylamine, or a water-soluble alkoxyamine.

The strong alkali of the extractant reacts with the phenolic —OH group on the anthracene ring. This salt formation reaction produces a much greater color in the marker and changes the color to a much more blue hue. The salt formation also stabilizes the color.

Although the marker may be extracted with an alkaline aqueous solution by itself, it is highly preferred that the extractant contain at least about 20 volume percent of a water-soluble, petroleum-insoluble cosolvent. The cosolvent helps to solvate both ionic and non-ionic species that produce the salt-forming reaction and stabilizes the resulting salt species. Suitable oxygenated cosolvents include alcohols, such as ethyl alcohol; glycols, such as ethylene glycol, diethylene glycol, propylene glycol, dipropylene glycol, polyethylene glycol, polypropylene glycol; glycerine; esters, such as methyl lactate, ethyl lactate and butyl lactate; sulfolane; dimethyl sulfoxide (DMSO), and dimethylformamide (DMF). Preferred cosolvents are the more oxygenated materials, such as glycerine, diethylene glycol and polyethylene glycol 300 and mixtures thereof. Suitable amine cosolvents include butyl amine, methoxypropylamine and methoxyethoxypropylamine.

As a simple field test, a suitable volume of the aqueous extractant mixture is mixed with a suitable volume of the liquid petroleum to be tested. Typically the volume ratio of extraction mixture to liquid petroleum is between about 1:1 and about 1:10. If marker is present in the petroleum product, it will be extracted and color enhanced by reaction with the extraction mixture. Colorometric equipment may be used to quantify the amount of marker in the aqueous layer. As long as similar conditions, e.g., volume-to-volume, ratios are used for similar liquid petroleum products, the color that is produced is quantitative. It should be noted that almost any dye used to impart color to petroleum products will not be extracted by the extractant mixture. Thus, the marker may be used in conjunction with a dye that colors the petroleum product. The dye masks the marker in the petroleum product. When testing for the marker, the extractant mixture extracts the marker, without extracting the dye.

One of the advantages of the invention is the simplicity of the qualitative test afforded by the markers and extraction/development solutions. Experience has indicated that inspectors in the field are often adverse to performing all but the most simple tests. The test as indicated above is a quick, one-step test. Convenience can be enhanced by providing an inspector a premeasured amount of extractant solution in an extraction vial and, preferably, means to measure an appropriate amount of petroleum product. For a rough estimate of marker level, the inspector might even be provided with a color chart against which to compare the developed color.

The invention will now be described in greater detail by way of specific examples.

EXAMPLE 1

1-Butyl Amino 4-Hydroxy 9,10 Anthracene Dione

To a 3 liter flask, 196 g 1,4 dihydroxy anthraquinone, 48 g 2,3, dihydro-1,4 dihydroxy anthraequinone, 5 g sodium carbonate, 600 g toluene are 20 g polypropylene glycol was charged. With stirring 82 g butylamine was added over one hour. When all amine was added, the reaction was heated to 70° C. over one hour and help 6 hours.

When the reaction was deemed complete (complete consumption of 1,4 dihydroxy anthraquinone) air was bubbled through the reaction mixture for 6 hours.

Toluene was then stripped from the reaction, under vacuum and replaced with 700 g methyl alcohol, added dropwise while maintaining a gentle reflux at 76°–78° C.

The reaction was cooled to 30° C. and the solid product isolated by filtration. The yield was determined after drying to be 310 g (92% pure).

EXAMPLE 2

1-Methoxyproylamino-4-Hydroxy-9,10-Anthracene Dione

Reaction was carried out as Example 1 except that 99.7 g methoxy-propylamine was substituted for butylamine. (Yield=316 g).

EXAMPLE 3

1-Pentylamino-4-Hydroxy-9,10-Anthracene Dione

Reaction was carried out as Example 1 except that 97.4 g pentylamine was used in place of butylamine. (Yield=309 g).

EXAMPLE 4

1-Methoxyethoxypropyl Amino-4-Hydroxy-9,10 Anthracene Dione

Reaction was carried out as Example 1 except that 150 g methoxy-ethoxypropylamine was substituted for butylamine. (Yield=316 g).

EXAMPLE 5

Liquid Formulation of Mixture of 1-Pentylamino and 1-Methoxy-Propylamino 4-Hydroxy Anthracene Dione To a 2-liter flask was added 78 g quinizarine, 42 g Leuco quinizarine, 100 g polypropylene glycol, 400 g xylene, 34.3 g pentylamine and 14.7 g methoxylpropylamine. The amines, added last, were added simultaneously. The reaction was heated to reflux, 107° C., and held for 10 hours before beginning air oxidation.

After 4 hours of air oxidation, the xylene was stripped and replaced with high boiling aromatic solvent. The solution was standarized to 20% strength of the solid with solvent. Yield was 725 g.

EXAMPLE 6

Liquid Formulation of Mixture of 1-Butylamino and 1-Methoxypropylamino 4-Hydroxy-9,10-Anthracene Dione To a 2 liter flask was added 78 g quinizarine, 42 g Leuco quinizarine, 100 g polypropylene glycol, 400 g toluene.

Butylamine (29.2 g) and 14.7 g methoxypropylamine were then added simultaneously. The reaction was heated to reflux and held for 8 hours.

When the reaction was complete, it was oxidized with air of 4 hours.

The toluene was then stripped and replaced with high boiling aromatic solvent. The solution was brought to standard strength with solvent.

EXAMPLE 7

Extraction of Compound Prepared in Example 1 From Fuel 1-butylamino-4-hydroxy-9,10 anthracene dione (10 mg) was dissolved in 1 liter of gasoline.

A reagent consisting of 5 parts glycerine, 4 parts water and 1 part 50% sodium hydroxide was prepared. The reagent mixture (2 ml) was transferred to a glass sample vial. The marked fuel (20 ml) was added to the sample vial and the vial shaken vigorously. The mixture separated into an upper petroleum phase and a lower aqueous phase. The purple color observed in the aqueous phase confirmed the presence of the 1-butylamino-4-hydroxy-9,10, anthracene dione in the marked gasoline.

EXAMPLE 8

Extraction of Mixture 1 (Example 5) From Fuel

A reagent consisting of 6 parts propylene glycol, 3 parts water and 1 part 45% potassium hydroxide was prepared.

One milliliter of this reagent was then placed in a sample vial. Fuel (10 ml) marked at 20 ppm with Mixture 1 was added to the sample vial and the vial vigorously shaken. The purple color observed in the lower aqueous phase confirmed the presence of Mixture 1 in the marked fuel.

EXAMPLE 9

Extraction of Mixture 2 (Example 6) From Fuel

A reagent consisting of 15 parts methoxyethoxypropylamine, 15 parts water and 2 parts 45% potassium hydroxide in water was prepared. One milliliter of this reagent was vigorously shaken with 10 cc fuel which had been marked at 10 ppm with Mixture 2. The lower aqueous phase separated a purple color, confirming the presence of the marker in the fuel sample.

While the invention has been described in terms of certain preferred embodiments, modifications obvious to one with ordinary skill in the art may be made without departing from the scope of the present invention.

Various features of the invention are set forth in the following claims.

What is claimed is:

1. A method of tagging a liquid petroleum product with a marker and detecting said marker, the method comprising:

(A) adding to a liquid petroleum product between about 1 and about 100 ppm of a marker which is a compound or mixture of compounds having the formula:

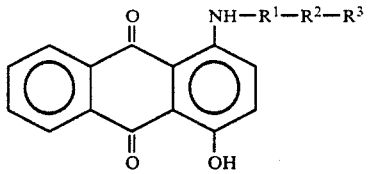

wherein $R^1$ is $C_1$-$C_6$ alkyl, and $R^2$ and $R^3$ are nothing or —O—($C_1$-$C_3$ alkyl); and (B) subsequently extracting said marker from said liquid petroleum product with an extractant comprising between about 20 and 100 volume percent of an aqueous solution of up to about 10 wt. % NaOH or KOH and up to about 80 volume percent of water-soluble organic cosolvent.

2. A method according to claim 1 wherein said cosolvent is selected from the group consisting of an oxygenated cosolvent, an alkyamine, an alkoxyamine and mixtures thereof.

3. A method according to claim 1 wherein said cosolvent is selected from the group consisting of ethyl alcohol, glycols, glycerine, esters, sulfolane, dimethyl sulfoxide, dimethylformamide, butyl amine, methoxypropylamine, methoxyethoxypropylamine and mixtures thereof.

4. A liquid petroleum product tagged with between about 1 and about 100 ppm of a marker which is a mixture of a first compound of formula:

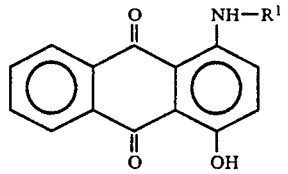

wherein $R^1$ is $C_1$-$C_6$ alkyl, and a second compound of formula:

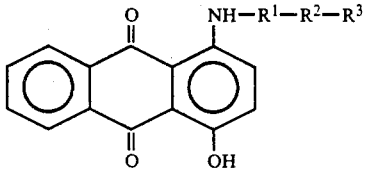

wherein $R^1$ is as defined above, $R^2$ is —O—($C_1$-$C_3$ alkyl) and $R^3$ is —O—($C_1$-$C_3$ alkyl) or nothing, the ratio of said first compound to said second compound being between about 5:1 and about 1:5.

* * * * *